US006934974B1

(12) United States Patent
Pantos et al.

(10) Patent No.: US 6,934,974 B1
(45) Date of Patent: Aug. 30, 2005

(54) FORCE ADJUSTABLE TOILET SEAT LIFTING AND LOWERING MECHANISM

(76) Inventors: William P. Pantos, 1549 San Elijo, Cardiff, CA (US) 92007; Curtis Sword, 1549 San Elijo, Cardiff, CA (US) 92007

( * ) Notice: Subject to any disclaimer, the term of this patent is extended or adjusted under 35 U.S.C. 154(b) by 32 days.

(21) Appl. No.: 10/979,039

(22) Filed: Nov. 2, 2004

Related U.S. Application Data

(60) Provisional application No. 60/543,879, filed on Feb. 12, 2004.

(51) Int. Cl.[7] ..... A47K 13/10
(52) U.S. Cl. ..... 4/246.1; 4/241; 4/248
(58) Field of Search ..... 4/241, 246.1, 246.3–246.5, 4/248

(56) References Cited

U.S. PATENT DOCUMENTS 2,705,330 A * 4/1955 Knudsen ..... 4/246.1
5,444,877 A * 8/1995 Kumarasurier ..... 4/246.1

* cited by examiner

*Primary Examiner*—Tuan Nguyen
(74) *Attorney, Agent, or Firm*—Steven W. Webb

(57) ABSTRACT

A toilet seat lifter means is described, using a minimally simple lever and gear means with a counterweight balanced action arm. The device is adaptable to all standard toilets available today and offers a minimum number of moving parts and no springs or pulleys.

4 Claims, 3 Drawing Sheets

FORCE ADJUSTABLE TOILET SEAT LIFTING AND LOWERING MECHANISM

RELATED U.S. APPLICATIONS

This application supplements and completes Provisional Application 60/543,879, filed Feb. 12, 2004.

FIELD OF THE INVENTION

This invention relates to toilet appliances having to do with lifting or adjusting the toilet seat position. The field contains several toilet seat adjusters with a variety of mechanical means.

BACKGROUND OF THE INVENTION

This is a simplified method for raising and lowering a standard toilet seat without touching the seat with the hands. It is compatible with and can be retrofitted to all standard toilets without requiring specialized seat assemblies. The mechanical implementation minimizes or eliminates springs, friction, ratchets, and flanges and has a unique adjustable counterweight design.

The state of the art is replete with competing designs, most of which are of limited practicality and usefulness. Jackson in U.S. Pat. No. 6,738,990 teaches a pedal operated lifter that uses a complex support framework and pulleys. Joseph in U.S. Pat. No. 5,875,498 uses pulleys and springs for a pedal-operated system, a solid framework attached to the floor. Kumarasurier in U.S. Pat. No. 5,444,877 shows a pedal-operated system with ratcheted gears and interior bearings that is not adjustable with a counterweight. Wolfer in U.S. Pat. No. 5,280,654 presents a system that is superficially similar to the present invention, but does not fit standard toilet seats and possesses an inferior lever action. The remainder of the art is substantially distinct from this invention.

OBJECTS OF THE INVENTION

It is an object of this invention to provide a toilet seat lifter that requires no use of the hands to operate, thereby improving personal hygiene.

It is a further goal of this invention to produce this device with the minimum number of moving parts.

It is a further goal of this invention to implement this toilet seat lifter with no parts that can wear out easily and require continuous replacement.

It is a further goal of this invention to reduce friction and provide a counterweight that will minimize the force necessary to lift and lower a toilet seat with this device.

SUMMARY OF THE INVENTION

The mechanism is an extruded or stamped metal or plastic housing to which is attached an adapter bracket for connection to the toilet seat. The housing possesses two interlocking gears, the gears attached to two separate lever arms.

The longer lever arm extends towards the floor and the shorter lever arm connects to an attachment clip on the underside of the toilet seat. The longer lever arm has a counterweight that regulates the speed of the toilet seat lowering. The attachment clip also places friction on the small lever arm that regulates the speed of the seat lifting and lowering.

The hardware is under the seat and out of sight of the user. This invention can be installed on the left or right side of any toilet. The entire assembly can be easily retrofitted with adjustment hardware to any standard toilet in use today.

BRIEF DESCRIPTION OF THE DRAWINGS

The features of this invention will be best understood from the accompanying drawings, taken in conjunction with the accompanying description.

DESCRIPTION OF THE PREFERRED EMBODIMENT

Figure 1:
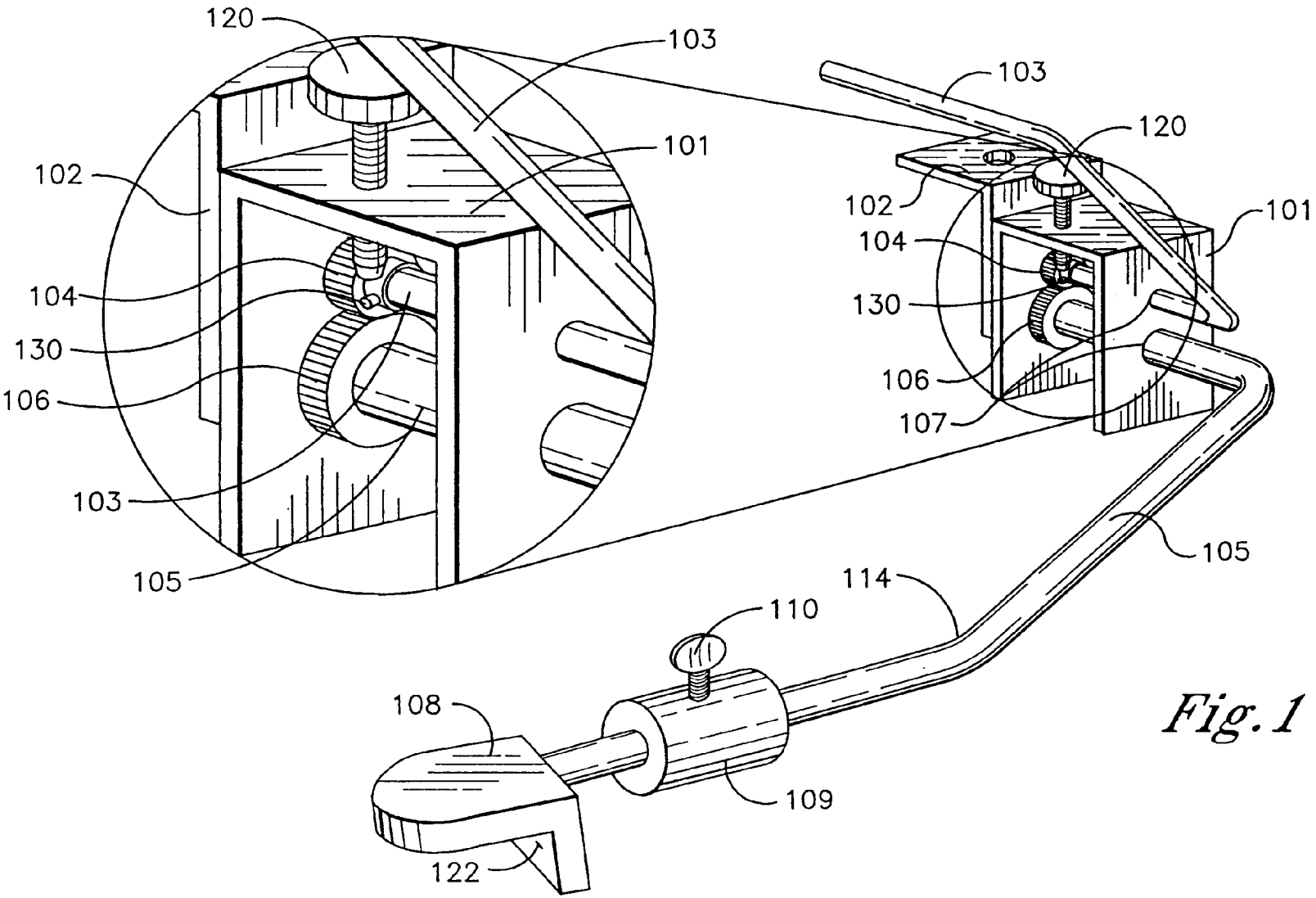
FIG. 1 is a perspective and expanded view of the invention

The invention can be seen best in FIG. 1, and it consists of a housing101, an adapter bracket102, a small lever arm103 connected to a small gear104, a large lever arm105 connected to a large gear106, the two gears104,106 held within the housing by means of lever entry holes107.

Figure 2:
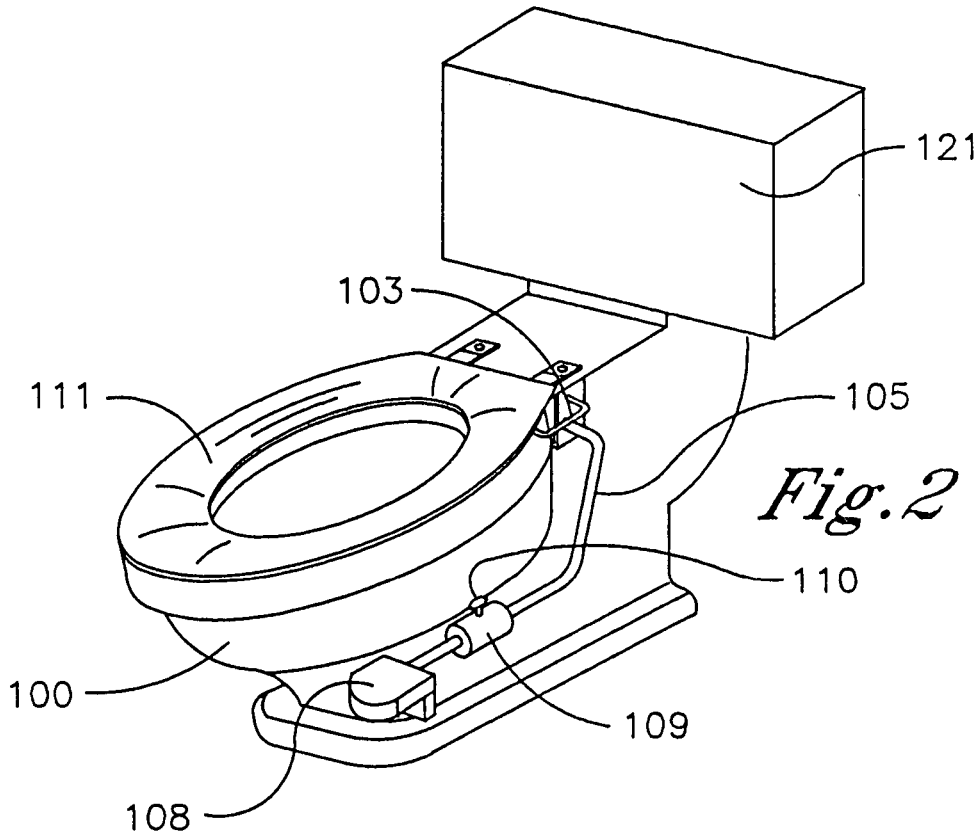
FIG. 2 is view of the invention attached to the toilet, seat down
Figure 3:
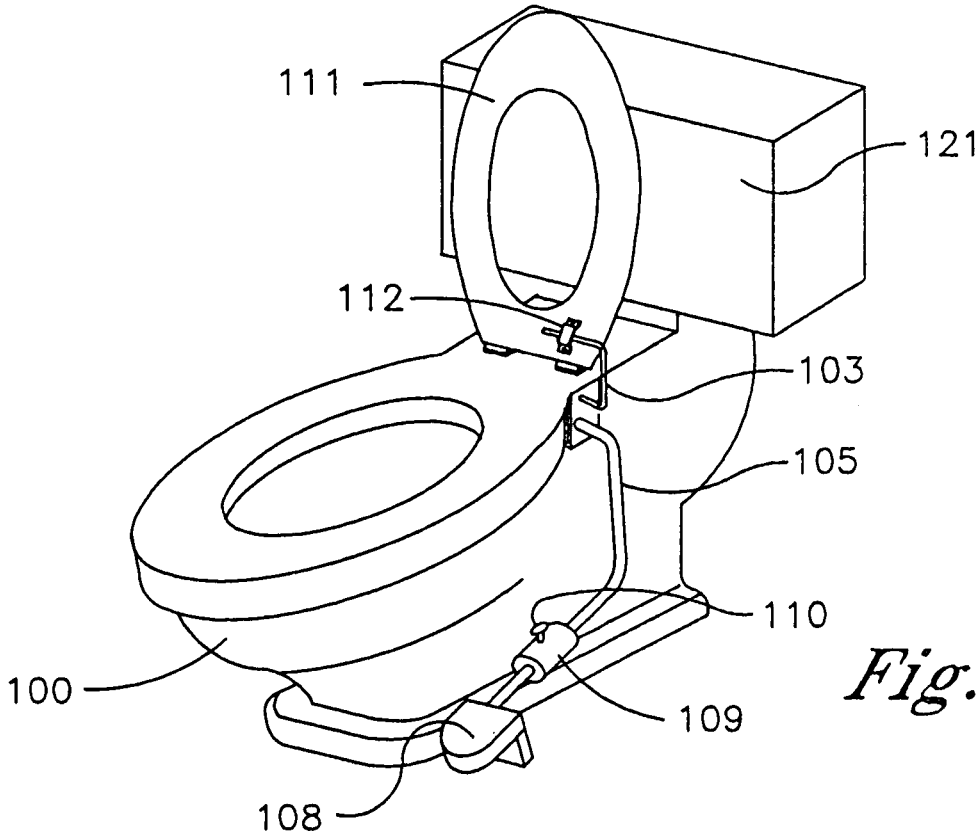
FIG. 3 is a view of the invention attached to the toilet, seat up
Figure 4:
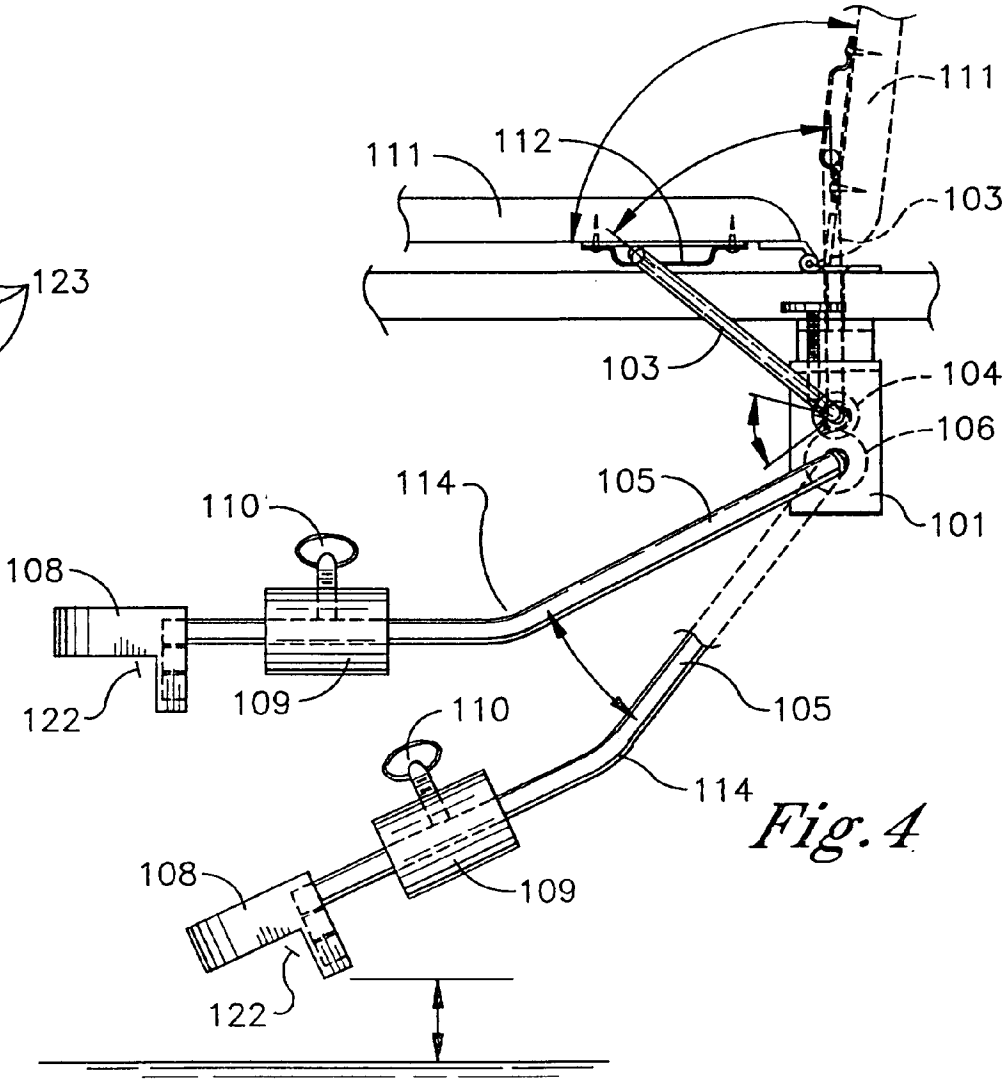
FIG. 4 is a side view of the invention in action
Figure 5:
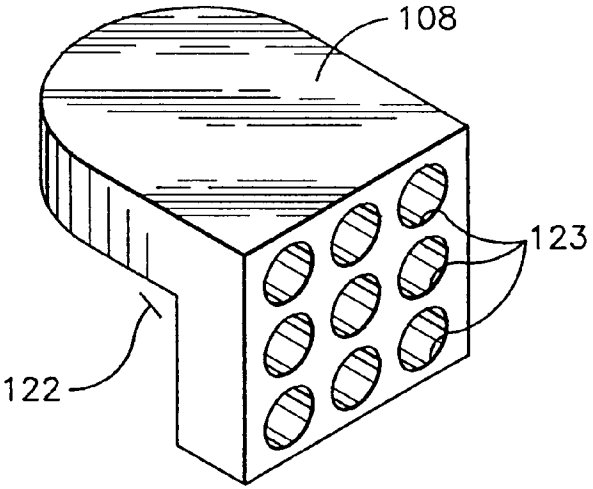
FIG. 5 is a perspective view showing the pedal configuration.

The large lever arm105 extends away from the housing101 alongside a toilet100 towards the floor, as in FIG. 2 and FIG. 3, and possess a pedal108 and adjustable counterweight109 with adjustment means 110. As seen in FIG. 3, the small lever arm103 is attached to the underside of the toilet seat 111 by means of an attachment clip112. As can be seen in FIG. 4, by means of this clip112, the seat111 can be raised by pressing with the foot on the pedal 108 at the end of the large lever arm105, and lowered by lifting the pedal108 with the foot. When the seat111 is lifted, the small lever arm103 slides from one end of the attachment clip112 to the other, allowing the seat111 to be lifted with only a small angular rotation of the small lever arm103.

Looking at FIG. 1, there is a thumbwheel screw120 that passes from the outside into the interior of the housing101. This thumbwheel screw120 is used to control the stopping position of the small lever arm 103 to prevent the seat111 from hitting the toilet tank121.

The counterweight109 can be moved up or down the length of the large lever arm105 between the pedal108 and the large lever arm angle114. This adjustment accommodates the amount of force needed to prevent the toilet seat111 from slamming when closing.

The pedal108 is shaped to permit a space122 under the upper surface of the pedal to position the foot for lifting the pedal108. The pedal possesses a multiplicity of holes123 that permit the insertion of the large lever arm105. By means of choosing which hole123 in which to insert the large lever arm105, the distance above the ground the pedal108 rests when the toilet seat111 is raised can be adjusted.

While the foregoing describes a preferred embodiment, variation on this design and equivalent designs may be resorted to in the scope and spirit of the claimed invention.

What is claimed is:

1. A toilet seat lifter, comprised of a housing, an adapter bracket, a small lever arm, a large lever arm, a small gear, a large gear, a counterweight, and a seat lift adjustment means, the housing connected fixedly to the adapter bracket, the housing and adapter bracket capable of being attached to a standard toilet behind the placement of the toilet seat, the small gear and large gear connected by gear engagement, the small lever arm connected fixedly to the center of rotation of the small gear, the large lever arm connected fixedly to the center of rotation of the large gear, the small and large lever arms bent in such a manner that the motion of the large lever arm rotates the large gear and the motion of the small gear moves the small lever arm, the small lever arm connected removably to the underside of a standard toilet seat by means of an attachment clip, the end of the small lever arm inserted through the attachment clip capable of sliding the length of the attachment clip while the seat is lifted, said sliding motion minimizing the angular distance turned by the small gear, the large lever arm possessing a counterweight that is adjustable by sliding the counterweight along the length of the large lever arm, the large lever arm possessing a pedal at the end of the large lever arm away from the large gear, the pedal possessing a multiplicity of insertion holes that are capable of receiving the end of the large lever arm, the distance the pedal stops above the ground when the pedal is depressed adjustable by means of selecting an appropriate hole in which to insert the large lever arm, the pedal held on the end of the large lever arm by means of friction, the large lever arm extending from the housing behind the standard toilet seat towards the floor without contacting the floor, the toilet seat lifter operated by attaching the housing with the adapter bracket behind the toilet seat such that one end of the small lever arm is connected removably to the underside of the standard toilet seat, the large lever arm extending alongside the toilet stool towards the floor, the counterweight adjusted along the length of the large lever arm to a position that balances the weight of the toilet seat and regulates the speed of the seat descent to the down position, the seat lifted by pressing the pedal at the end of the large lever arm with the foot until the toilet seat is all the way up, the seat lowered by lifting the pedal with the foot until the toilet seat starts towards the down position.

2. The toilet seat lifter of claim 1 where the housing and adapter bracket are comprised of extruded or stamped aluminum.

3. The toilet seat lifter of claim 1 where the counterweight is held in place after adjustment along the large lever arm by means of a tightening screw.

4. The toilet seat lifter of claim 1 where the adjustment means is a screw inserted from the outside of the housing extending into the interior of the housing, the screw possessing a thumbwheel top, the screw capable of setting the up position of the toilet seat by stopping the small gear at an appropriate point in its revolution.

* * * * *